United States Patent [19]

Hadbavny

[11] Patent Number: 4,695,037

[45] Date of Patent: Sep. 22, 1987

[54] LIFTING APPARATUS

[76] Inventor: David L. Hadbavny, Box 283, Westmoreland City, Pa. 15692

[21] Appl. No.: 23,115

[22] Filed: Mar. 6, 1987

[51] Int. Cl.[4] ..... B66F 11/00

[52] U.S. Cl. ..... 254/131

[58] Field of Search ..... 254/120, 131, 132, 30, 254/DIG. 1; 294/17; 414/494, 684.3

[56] References Cited

U.S. PATENT DOCUMENTS

| | | | |
|---|---|---|---|
| 2,846,259 | 8/1958 | Sadler . | |
| 3,198,362 | 8/1965 | Berg . | |
| 3,985,338 | 10/1976 | Herrmann . | |
| 4,055,330 | 10/1977 | Chapman | 254/131 |
| 4,250,769 | 2/1981 | Herring . | |
| 4,365,925 | 12/1982 | Girtz . | |
| 4,482,182 | 11/1984 | Mortensen . | |
| 4,488,706 | 12/1984 | Kono . | |
| 4,512,554 | 4/1985 | Racine . | |

*Primary Examiner*—Robert C. Watson

*Attorney, Agent, or Firm*—H. Keith Hauger

[57] ABSTRACT

A lifting apparatus is disclosed for lifting steel grates and the like. The apparatus includes a fulcrum member including an outer U-shaped support member and an inner U-shaped rim holding and support member. A lever is provided. A bolt passes through outer and inner U-shaped rim holding and support members and the lever. The apparatus is easy to use and folds for storage.

6 Claims, 6 Drawing Figures

LIFTING APPARATUS

BACKGROUND OF THE INVENTION

1. Field of the Invention

This invention relates generally to a lifting apparatus, and in particular, it is an apparatus for lifting steel grates, manhole covers, drain covers and other similar structural members. Steel grates, such as those used for storm sewers, frequently weigh 500 pounds and upward, and because of their weight and unwieldy size, cause difficulty in lifting and removing same. Workmen have encountered considerable difficulty in using conventional equipment like crowbars and road machinery equipped with hydraulic accessories. Recuring damages to said equipment has been resultant.

It is necessary to remove a grate or manhole cover to work within the pipelines or drains below. However, there are often long periods of time between grate removals, which allow the weather, road dirt, ashes, salt, and other debris to form between the cover and framework, bonding same together. The present invention is designed to eliminate demolition of the framework, which is often damaged by other types of equipment on the market.

2. Description of the Prior Art

The prior art includes various devices for lifting manhole covers and the like. For example, in U.S. Pat. No. 4,250,769 issued to Gerald F. Herring is disclosed a pivoted adjustable lever with grab link. Herring's apparatus uses an adjustable hand lever having a vertically adjustable tripod base and adjustable fulcrum point and a grab link at the working end of the lever. U.S. Pat. No. 4,512,554 issued to Jacques Racine is disclosed a levering tool for lifting manhole covers. The tool comprises a base provided with anti-skidding elements formed of studs and a series of parallel plates, and a rigid and elongated power bar. The tool works to displace the cover by applying a small force on the free end of the power bar while maintaining the anti-skid base substantially stable. In U.S. Pat. No. 4,488,706 issued to Kazuhiko Kono is disclosed a manhole lifting hook comprising a lever rod having a load end, at least one roller rotatably mounted on the lever rod and rollingly movable at least in a back-and-forth direction, and a hook mounted on the load end for engaging the hook hole in the manhole cover. U.S. Pat. No. 4,365,925 issued to Sylvester A. Girtz discloses a manhole cover lifter comprising an elongated inclining lever with a handle at its upper end and a fastener at its lower end for attaching to the cover of the manhole. A depending strut intermediate the ends of the lever and a pair of wheels is mounted at the lower end of the strut and on a transverse axis forming a fulcrum for the lifting lever. U.S. Pat. No. 3,985,338 issued to Edgar R. Herrmann is disclosed a manhole cover lifter consisting of a long lever which at one end has a hook for engaging an opening through the manhole cover. A fulcrum is located relatively close to the end of the lever having a hook, so that when a workman places his foot upon the other end of the lever, he can pry the manhole upwardly for easy removal. U.S. Pat. No. 3,198,362 issued to Harold I. Berg is disclosed a relatively complex tool for lifting manhole covers. U.S. Pat. No. 4,482,182 issued to James W. Morensen and U.S. Pat. No. 2,846,259 issued to Ernest N. Sadler also discloses two other apparatuses for lifting manhole covers.

SUMMARY OF THE INVENTION

It is an object of this invention to provide a lifting apparatus for removing steel grates, manhole covers and the like which is easy and safe to use.

It is the further object of this invention to avoid disturbing or destroying the substructure of the framework around the grate or cover, the drop inlet and other surrounding structures resultant in saving man hours of labor and unnecessary repairs.

It is another object of the present invention to provide a lifting apparatus which may be folded into a compact unit for storage and can be quickly unfolded when the need requires.

The present invention provides a lifting apparatus comprising a fulcrum member. The fulcrum member includes an outer U-shaped support member having first apertures passing therethrough proximate the ends thereof. The inner U-shaped rim holding and support member has second apertures passing therethrough proximate ends thereof. A lever having a third aperture therethrough at a predetermined pivot point is provided.

The fulcrum member also comprises a bolt member. The bolt member passes through the first apertures of the outer U-shaped support member, the second apertures of the inner U-shaped rim holding and support member and the third aperture of the lever. A nut is affixed to the bolt member. Washers are placed along the axis of said bolt member and function as spacers between the various members.

A collapsible connector member is affixed at one end to the bottom of the outer U-shaped member and the collapsible connector member is affixed at the other end thereof to the bottom portion of the inner U-shaped rim holding and support member.

It is the further object of this invention that the inner U-shaped rim holding and support member applies considerable downward pressure on the rim or framework around the grate, whether it be constructed of metal or in the case of newer drains, pre fab concrete which does not incorporate a metal frame around the manhole or grate lid. It is to be noted that either type of inlet requires a wedging force to remove the grate lid or manhole cover.

The lever at one end proximate the third aperture has a groove therein in the upper edge thereof. The lever proximate the other end thereof preferably has a fourth aperture therethrough. Means for pulling the lever is provided and is affixed to the lever proximate the other end thereof. A grate engaging means is provided engagable with the lever proximate the groove.

Preferably the working portion of the lever below the third aperture has a predetermined width and a predetermined length such that the bottom working end portion may be housed within said inner U-shaped rim holding and support member. Also it is desirable that the lever above the third aperture comprises an upper handle portion having a length predetermined to be greater than said bottom working end portion. Preferably the inner U-shaped rim holding and support member is slideable within the outer U-shaped member.

It is also the further object of this invention to produce a durable lifting apparatus in all of its construction. This is necessary because when the grate lid is dislodged from its respective framework, the apparatus begins to function as a pulling devise exerting a horizontal force on said grate lid away from the work area.

Thus, it is the further object of this invention to not only lift the grate lid or manhole cover, but to pull same in continuous motion eliminating any manipulation by hands or participation by workers. It is during this pulling process that the lifting apparatus, by design, collapses under the forward motion and weight of the grate or cover. The apparatus, towing chain, and grate lid or manhole cover are simply pulled to safety by one effortless motion exerted by the initial power source, preferably a truck or other heavy duty vehicle. The aforesaid objects of this invention result in substantial reduction of the possibility of finger and/or hand injuries which prevail in this type of work. The apparatus also prevents other hazards including groin strains, neck and back injuries.

More specifically, the present invention is a lifting apparatus, said apparatus comprising fulcrum member means including an outer U-shaped support member and an inner U-shaped rim holding and support member, said outer U-shaped support member having first aperture means passing therethrough proximate the ends thereof, said inner U-shaped rim holding and support member having second aperture means passing therethrough proximate the ends thereof, a lever having third aperture means passing therethrough at a predetermined pivot point, said fulcrum member means further comprising a bolt member, said bolt member passing through said first aperture means of said outer U-shaped support member, said second aperture means of said inner U-shaped rim holding and support member and said third aperture means of said lever, a nut affixed to said bolt member, a collapsible connector member affixed at one end to the bottom of said outer U-shaped support member and said collapsible connector member affixed at the other end thereof to the bottom portion of said inner U-shaped rim holding and support member, said lever at one end thereof proximate said third aperture means having a groove therein in the upper edge thereof, means for pulling said lever affixed to said lever proximate the other end thereof, grate engaging means engagable with said lever proximate said groove, whereby upon affixing said grate engaging means to a grate and applying force by said means for pulling said lever said grate will lift with little physical effort, upon completion of use of said lifting apparatus it may be folded for easy storage.

These objects, as well as other objects and advantages of the present invention, will become apparent from the following description, on reference to the illustrations appended hereto.

BRIEF DESCRIPTION OF THE DRAWINGS

For a better understanding of the invention, reference may be had to the accompanying drawings, in which.

BRIEF DESCRIPTION OF THE PREFERRED EMBODIMENTS

Figure 2:
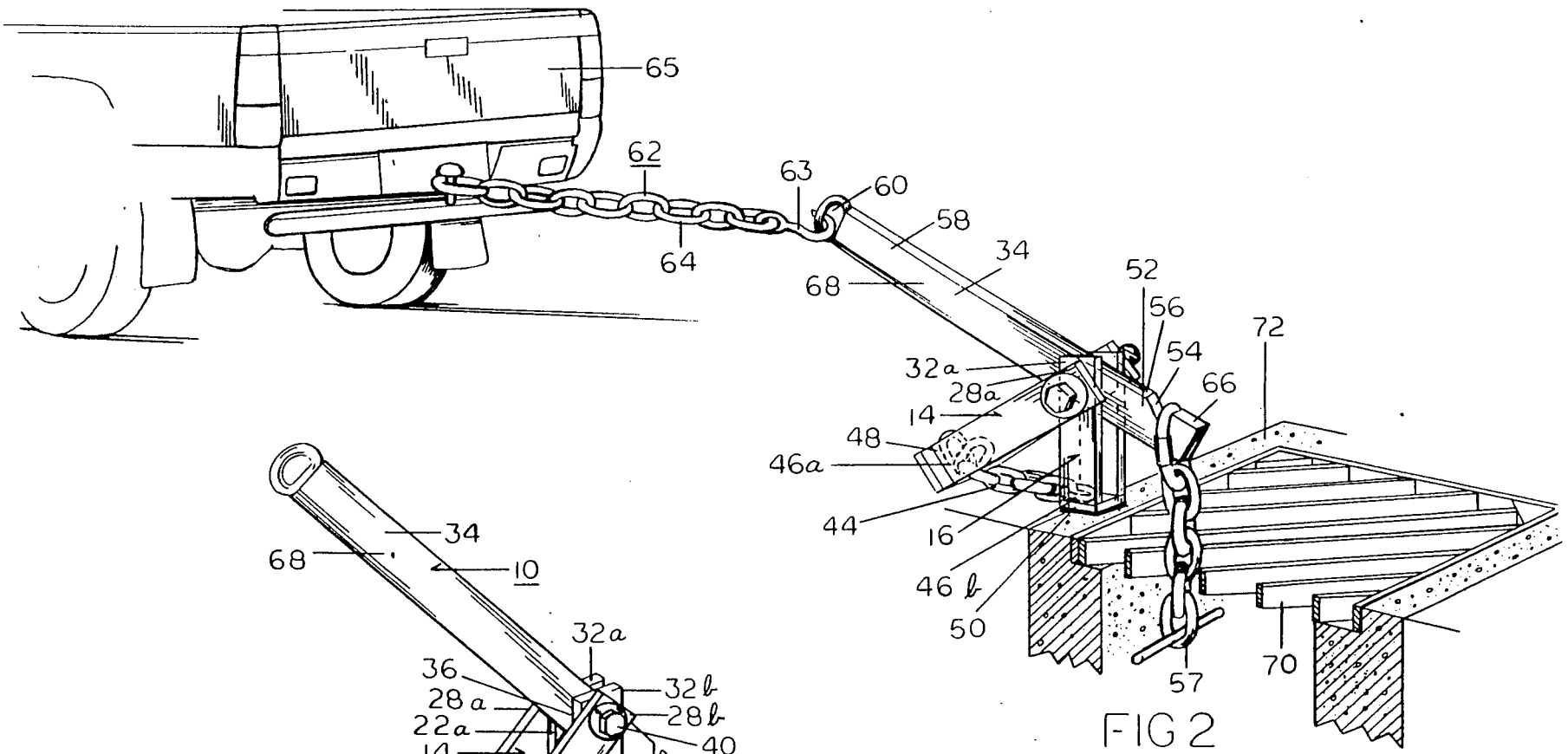
FIG. 2 is a second isometric view of the lifting apparatus which illustrates the operation.

With reference to FIGS. 1–6 there is shown the lifting apparatus of the present invention. As was discussed in the background of the invention, the lifting of heavy objects such as heavy metal grates in roadways and manhole covers is quite difficult and hazardous. The present invention provides a safe and efficient tool for performing such a job. Typically heavy metal grates such as shown in FIG. 2 rest inside a rim made of concrete or metal. Difficulty often arises in pulling the grate out because it bonds to the rim 72. Lifting apparatus 10 of the present invention comprises a fulcrum member 12 including an outer U-shaped support member 14 and an inner U-shaped rim holding and support member 16. As can be seen from FIGS. 1, 2 and 4 the outer U-shaped 14 may consist of two leg members 18*a*, 18*b* and a base 20. The leg members may be welded to the base 20, for example. The inner U-shaped rim holding and support member may also consist of two leg members 22*a*, 22*b* and a bottom joining member 24. Preferably the leg members are welded to the bottom joining member in the same manner for the outer U-shaped support member. The outer U-shaped member 14 has a first aperture 26 passing therethrough proximate the ends 28*a*, 28*b* thereof. The inner U-shaped rim holding and support member 16 preferably has a second aperture 30 passing therethrough proximate ends 32*a*, 32*b*.

Figure 3:
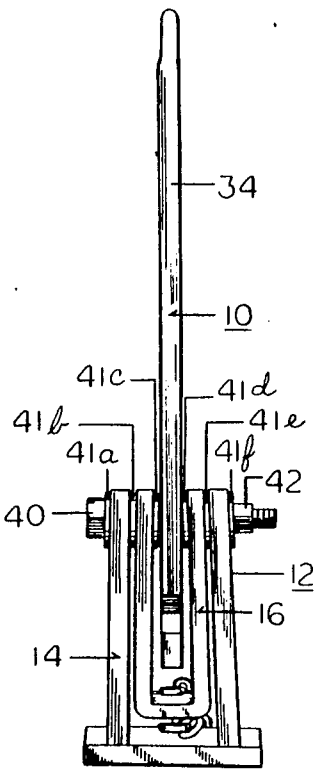
FIG. 3 is a front elevational view of the lifting apparatus shown in FIG. 1.

A lever 34 has third apertures 36 passing therethrough at a predetermined pivot point 38. The fulcrum member 12 further comprises a bolt member 40. The bolt member 40 passes through the first aperture 26 of the outer U-shaped support member 14, a second aperture 30 of the inner U-shaped rim holding and support member and the third aperture 36 of the lever. A nut 42 is affixed to the bolt member 40 as shown in FIG. 3. Washers 41*a* 41*b*, 41*c*, 41*d*, 41*e*, 41*f* are placed along the axis of bolt member 40 and function as spacers between the herein mentioned members.

A collapsible connector member 44 is affixed at one end 46*a* to the bottom portion 48 of the outer U-shaped member 14. The collapsible connector member 44 is affixed at the other end 46*b* to the bottom portion 50 to the inner U-shaped rim holding and support member 16.

The lever 34 at one end 52 thereof proximate the third aperture 36 has a groove 54 therein in the upper edge 56 thereof. The lever 34 proximate the other end 58 has a fourth aperture 60 therethrough.

Means for pulling lever 62 as shown in FIG. 2 is affixed to the lever 34 proximate the other end 58 thereof. Means for pulling the lever may consist of a chain 64 and hook 63 affixed thereto, both linking to the bumper of a pick-up truck 65, for example.

Figure 1:
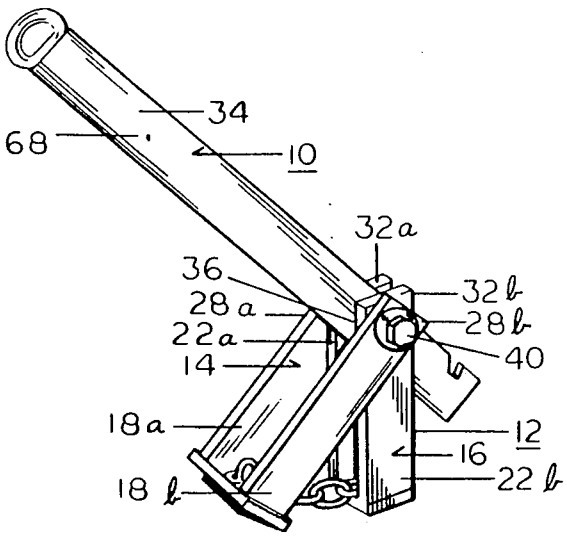
FIG. 1 is an isometric view of the lifting apparatus of the present invention.
Figure 6:
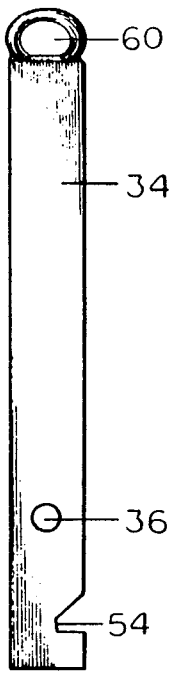
FIG. 6 is a side elevational view of the lever.
Figure 5:
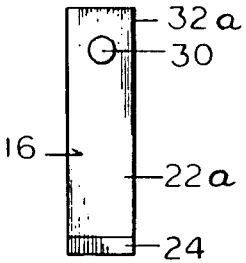
FIG. 5 is a side elevational view of the inner U-shaped support member.
Figure 4:
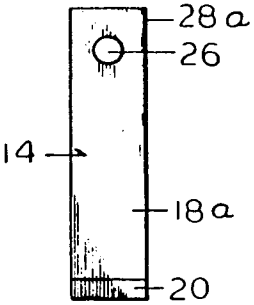
FIG. 4 is a side elevational view of the outer U-shaped support member.

Preferably the bottom working portion 66 of the lever below the third aperture 36 has a predetermined width and length such that the bottom working end portion 66 may be housed within inner U-shaped rim holding and support member as shown in FIGS. 1 and 3.

Preferably the lever comprises an upper handle portion 68 which is above the third aperture 36. The upper handle portion preferably has a length of predetermined amount greater than the bottom working end portion, such as four (4), for example.

Desirably the inner U-shaped rim holding and support member 16 is slideable within the outer U-shaped support member 14.

A grate engaging means 57 is provided, engagable with a lever 34 proximate the groove 54, whereby upon affixing the grate engaging means 57 to a grate 70 and applying the appropriate force by the means for pulling the lever 62, the lever will lift the grate with little physical effort. After completion of use of the lifting apparatus of the present invention, it may be folded compactly for easy storage.

Preferably, the bolt 40, washers 41*a*, 41*b*, 41*c*, 41*d*, 41*e*, 41*f* and nut 42 are made of case hardened tempered steel.

Preferably, the lever 34, outer U-shaped support member 14, and inner U-shaped rim holding and support member 16 are constructed from steel bar stock.

In operation the Inner U-shaped rim holding and support member 16 is positioned on top of rim 72 to hold rim 72 down and to overcome any bonding between the rim 72 and grate 70 while lifting the grate 70.

I claim:

1. A lifting apparatus, said apparatus comprising fulcrum member means including an outer U-shaped support member and an inner U-shaped rim holding and support member, said outer U-shaped support member having first aperture means passing therethrough proximate the ends thereof, said inner U-shaped rim holding and support member having second aperture means passing therethrough proximate ends thereof, a lever having third aperture means passing therethrough at a predetermined pivot point, said fulcrum member means further comprising a bolt member, said bolt member passing through said first aperture means of said outer U-shaped support member, said second aperture means of said inner U-shaped rim holding and support member and said third aperture means of said lever, a nut affixed to said bolt member, a collapsible connector member affixed at one end to the bottom of said outer U-shaped support member and said collapsible connector member affixed at the other end thereof to the bottom portion of said inner U-shaped rim holding and support member, said lever at one end thereof proximate said third aperture means having a groove therein in the upper edge thereof, means for pulling said lever affixed to said lever proximate the other end thereof, grate engaging means engagable with said lever proximate said groove, whereby upon affixing said grate engaging means to a grate and applying force by said means for pulling said lever said grate will lift with little physical effort, upon completion of use of said lifting apparatus it may be folded for easy storage.

2. The lifting apparatus of claim 1, wherein said lever proximate the other end thereof having a fourth aperture means therethrough, said means for pulling said lever passing through said fourth aperture.

3. The lifting apparatus of claim 1, wherein a bottom working portion of said lever below said third aperture means has a predetermined width and a predetermined length such that said bottom working end portion may be housed within said inner U-shaped rim holding and support member.

4. The lifting apparatus of claim 1, wherein said lever above said third aperture comprises an upper handle portion, said handle portion having a length a predetermined amount greater than said bottom working end portion.

5. The lifting apparatus of claim 1, wherein said inner U-shaped rim holding and support member is slideable within said outer U-shaped member.

6. The lifting apparatus of claim 1, further comprising a multitude of spacer means along an axis of said bolt means.

* * * * *